US005662276A

United States Patent [19]

Ko

[11] Patent Number: 5,662,276

[45] Date of Patent: Sep. 2, 1997

[54] CHECK ASSEMBLY OF A SPRINKLING HEAD FOR A KITCHEN CABINET

[75] Inventor: Hsi-Chia Ko, Changhua Hsien, Taiwan

[73] Assignee: Chung Cheng Faucet Co., Ltd., Taiwan, Taiwan

[21] Appl. No.: 535,635

[22] Filed: Sep. 28, 1995

[51] Int. Cl.[6] ..... B05B 1/30

[52] U.S. Cl. ..... 239/571; 239/526; 137/218; 137/614.2

[58] Field of Search ..... 239/525, 526, 239/571; 137/218, 614.2

[56] References Cited

U.S. PATENT DOCUMENTS

| | | | |
|---|---|---|---|
| 4,148,438 | 4/1979 | Moen | 239/571 |
| 4,927,115 | 5/1990 | Bahroos et al. | 251/241 |
| 5,079,781 | 1/1992 | Gnauert et al. | 137/218 X |
| 5,240,029 | 8/1993 | Ludewig | 137/218 X |

*Primary Examiner*—Andres Kashnikow
*Assistant Examiner*—Steven J. Ganey
*Attorney, Agent, or Firm*—Beveridge, DeGrandi, Weilacher & Young, L.L.P.

[57] ABSTRACT

A check assembly of a sprinkling head for a kitchen cabinet. The sprinkling head is a hollow L-shaped tube member having a sprinkling opening. A controlling depression grip is connected to a bight section of the sprinkling head. A controlling valve stem is disposed in the sprinkling head. An upper end of the valve stem protrudes out of the bight section and two watertight washers are fitted around the valve stem to abut against peripheral wall of a water outlet formed in the sprinkling head. A lower end of the valve stem is fitted with a conic spring and check assembly and an end of the sprinkling head is connected with a water hose. By means of depressing the depression grip, the controlling valve stem is lifted or lowered to control the sprinkling of the water flow from the sprinkling opening. The check assembly includes a check valve seat, a plastic pin member fitted in the valve seat, a rubber-made soft conic check pad fitted around the pin member and a water inlet seat fitted with the valve seat. The check valve seat is engaged with the water inlet seat and molten and sealed at an end of the water inlet seat by high frequency wave. The water inlet seat is engaged with the sprinkling head which is further engaged with the water hose. In case an accident takes place with the sprinkling head placed in a sink after washed, the dirty water is prevented from flowing back into the water hose due to syphon effect.

1 Claim, 4 Drawing Sheets

CHECK ASSEMBLY OF A SPRINKLING HEAD FOR A KITCHEN CABINET

BACKGROUND OF THE INVENTION

The present invention relates to a check assembly of a sprinkling head for a kitchen cabinet, which, includes a check valve seat, a plastic pin member fitted in the valve seat, a rubber-made soft conic check pad fitted around the pin member and a water inlet seat fitted with the valve seat. In case an accident takes place with the sprinkling head placed in a sink after washed, the dirty water is prevented by the check assembly from flowing back into the water hose due to syphon effect.

FIG. 1 shows a conventional sprinkling head for a kitchen cabinet. The sprinkling head 10 is a hollow L-shaped tube member having a sprinkling opening 11 at one end. A controlling depression grip 13 is connected to a bight section of the sprinkling head 10. A controlling valve stem 20 is disposed in a long pipe section of the sprinkling head 10. An upper end of the valve stem 20 protrudes out of the bight section and two watertight washers 21 are fitted around the valve stem 20 to abut against peripheral wall of a water outlet formed in the sprinkling head 10. A lower end of the valve stem 20 is fitted with a conic spring 30 and an end of the sprinkling head 10 is connected with a water hose 50. By means of depressing the depression grip 13, the controlling valve stem 20 is lifted or lowered to control the sprinkling of the water flow from the sprinkling opening 11.

Referring to FIG. 2-1, in normal state, the valve stem 20 is pushed upward by the conic spring 30 with the watertight washer 21 abutting against peripheral wall of the water outlet. As shown in FIG. 2-2, when the depression grip 13 is depressed, the valve stem 20 is lowered to compress the conic spring 30. At this time, the watertight washer 21 is separated from the water outlet, permitting the water to flow from the water hose 50 into the sprinkling head 10 to be sprinkled out. When the depression grip 13 is released, the valve stem 20 is upward pushed by the restoring force of the conic spring 30 and the watertight washer 21 again abuts against the peripheral wall of the water outlet to shut off the water.

According to the above structure. The conventional sprinkling head is able to wash and clean the sink of the kitchen cabinet. However, in case an accident such as a fire takes place and the sprinkling head is placed in the sink filled with dirty water, the conic spring may be reversely compressed due to sucked back into the water hose by high water pressure. The dirty water which may contain bacteria or chemicals will thus flow into other pipe lines of the same water supply system. This will cause contamination of the public water supply system.

Therefore, it is necessary to develop a sprinkling head structure for kitchen cabinet, which can prevent the dirty water from flowing back into the pipe line so as to ensure hygiene in public water supply.

SUMMARY OF THE INVENTION

It is therefore a primary object of the present invention to provide a check assembly of a sprinkling head for a kitchen cabinet. In case an accident such as a fire takes place with the sprinkling head placed in a sink after washed, the dirty water is prevented by the check assembly from flowing back into the water hose due to syphon effect.

According to the above object, the check assembly includes a check valve seat, a plastic pin member fitted in the valve seat, a rubber-made soft conic check pad fitted around the pin member ahd a water inlet seat fitted with the valve seat. The check valve seat is a cylindrical body having a lower opening. A cross-like rib is formed on a top face of the valve seat and a hollow post extends downward and upward from a center of the cross-like rib. An annular flange is formed on outer wall of a middle section of the valve seat. One end of the pin member is disposed with a pin head and the other end thereof is a pin post. An upper face of the check pad is formed with a large sink and a lower face thereof is formed with a small sink. The two sinks are communicated by a central through hole. The pin post of the pin member is upward passed through the through hole to fit through a spring into the hollow post of the valve seat with the pin head engaged in the small sink of the check pad. The flange of the check valve seat is engaged with the water inlet seat and molten and sealed at an end of the water inlet seat by high frequency wave. An annular lip is formed in a water inlet of the water inlet seat, whereby the conic check pad is plugged into the water inlet and engaged with the annular lip. The water inlet seat has an outer thread section for engaging with inner thread of the long pipe section of the sprinkling head. The free end of the long pipe section is further engaged with the water hose. When the depression grip is depressed and the water flows through the water hose into the sprinkling head, the water first passed through the check assembly to upward push the conic check pad and compress the spring, permitting the water to enter the sprinkling head to be sprinkled out from the sprinkling opening. After the depression grip is released, the check pad is pushed back to abut against the annular lip of the water inlet by the restoring force of the spring so that the dirty water is prevented from flowing back into the water hose due to syphon effect.

The present invention can be best understood through the following description and accompanying drawings, wherein:

BRIEF DESCRIPTION OF THE DRAWINGS

FIG. 2-1 is a sectional assembled view of the conventional sprinkling head, in which the depression grip is not depressed;

FIG. 2-2 is a sectional assembled view according to FIG. 2-1, in which the depression grip is depressed, permitting water to flow into the sprinkling head;

FIG. 4-1 is a sectional assembled view of the present sprinkling head, in which the depression grip is not depressed; and FIG. 4-2 is a sectional assembled view according to FIG. 4-1, in which the depression grip is depressed, permitting water to flow into the sprinkling head.

DETAILED DESCRIPTION OF THE PREFERRED EMBODIMENT

Figure 3:
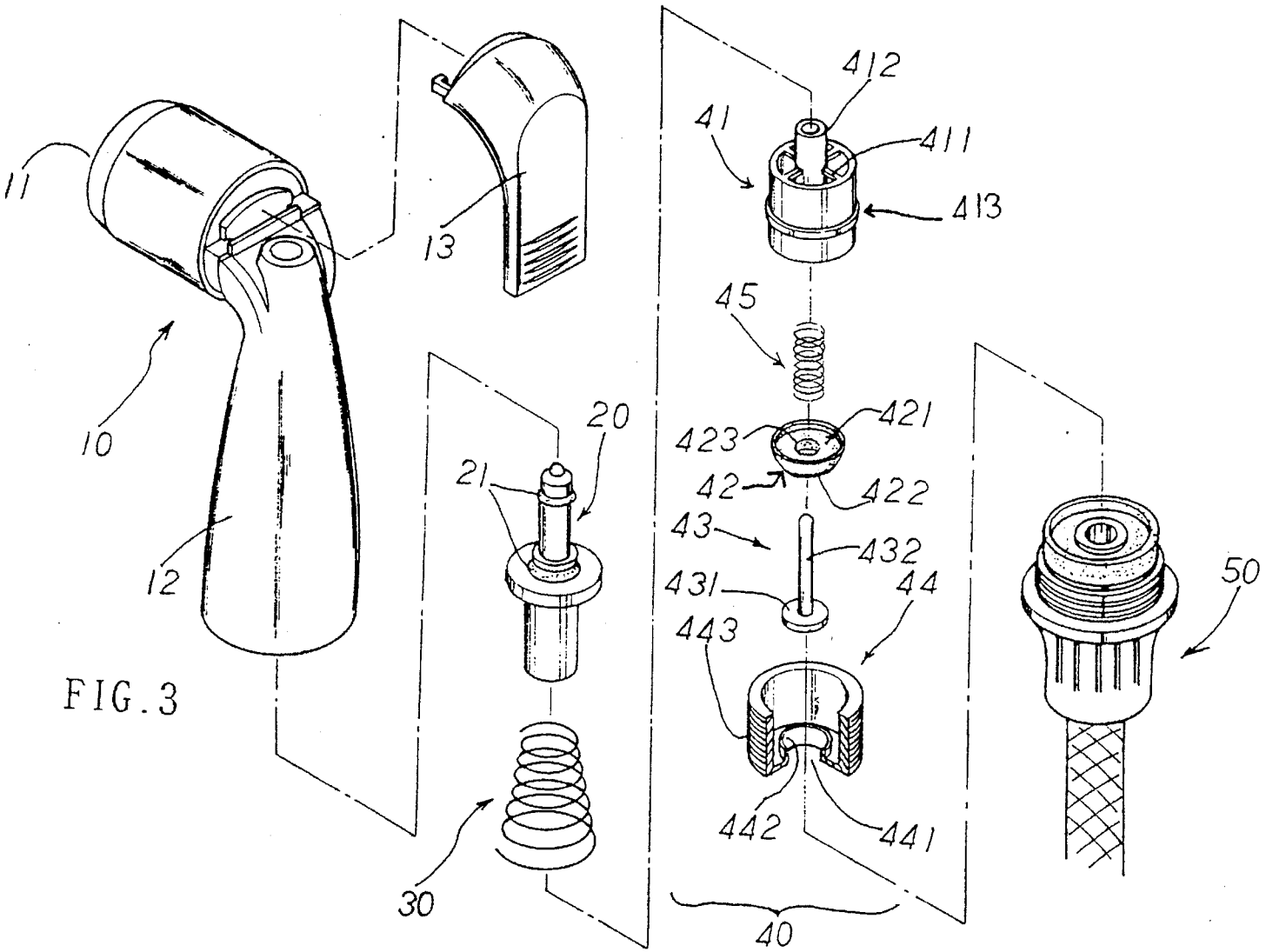
FIG. 3 is a perspective exploded view of the present invention.

Please refer to FIG. 3. The sprinkling head 10 of the present invention is a hollow L-shaped tube member, having a sprinkling opening 11 at a free end of a short pipe section of the sprinkling head 10. A controlling depression grip 13 is connected to a bight section of the sprinkling head 10. A controlling valve stem 20 is disposed in a long pipe section 12 of the sprinkling head 10. An upper end of the valve stem 20 protrudes out of the bight section and two watertight washers 21 are fitted around the valve stem 20. One of the watertight washers 21 abuts against peripheral wall of a water outlet formed in the sprinkling head 10. A lower end of the valve stem 20 is fitted with a conic spring 30 and a check assembly 40 and a free end of the long pipe section 12 is connected with a water hose 50, whereby by means of depressing the depression grip 13, the controlling valve stem 20 is lifted or lowered to control the sprinkling of the water flow from the sprinkling opening 11.

Figure 1:
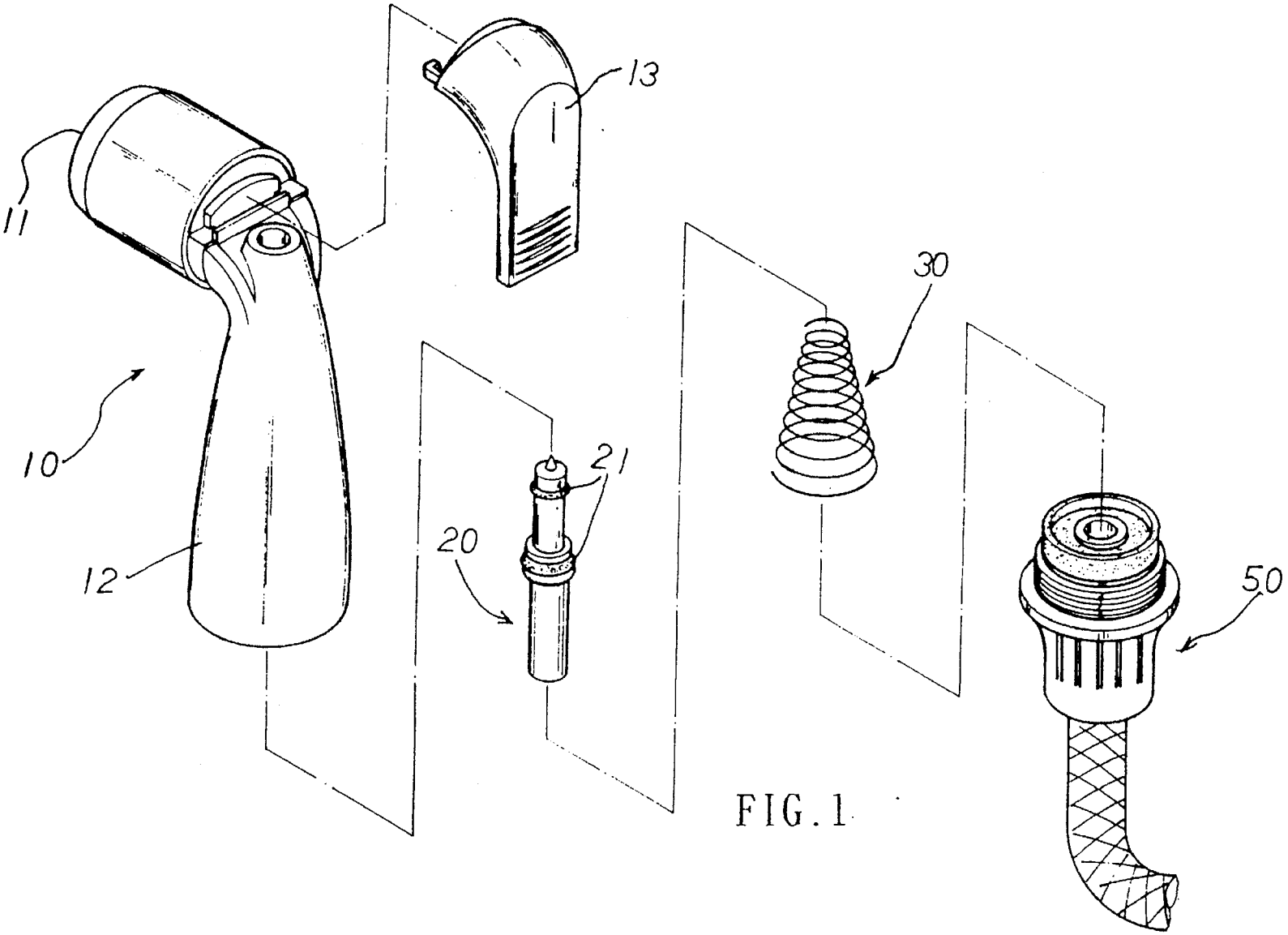
FIG. 1 is a perspective exploded view of a conventional sprinkling head for kitchen cabinet.

The check assembly 40 includes a check valve seat 41, a plastic pin member 43 fitted in the valve seat 41, a rubber-made soft conic check pad 42 fitted around the pin member 43 and a water inlet seat 44 fitted with the valve seat 41. The check valve seat 41 is a cylindrical body having a lower opening. A cross-like rib 411 is formed on a top face of the valve seat 41 and a hollow post 412 extends downward and upward from a center of the cross-like rib 411. An annular flange 413 is formed on outer wall of a middle section of the valve seat 41. One end of the pin member 43 is disposed with a pin head 431 and the other end thereof is a pin post 432. An upper face of the check pad 42 is formed with a large sink 421 and a lower face thereof is formed with a small sink 422. The two sinks 421, 422 are communicated by a central through hole 423. The pin post 432 of the pin member 43 is upward passed through the through hole 423 to fit through a spring 45 into the hollow post 412 of the valve seat 41 with the pin head 431 engaged in the small sink 422 of the check pad 42. The flange 413 of the check valve seat 41 is engaged with the water inlet seat 44 and molten and sealed at an end of the water inlet seat 44 by high frequency wave. An annular lip 442 is formed in a water inlet 441 of the water inlet seat 44, whereby the conic check pad 42 is plugged into the water inlet 441 and engaged with the annular lip 442. The water inlet seat 44 has an outer thread section 443 for engaging with inner thread of the long pipe section 12 of the sprinkling head 10. The free end of the long pipe section 12 is further engaged with the water hose 50 as shown in FIG. 4-1.

Figure 2:
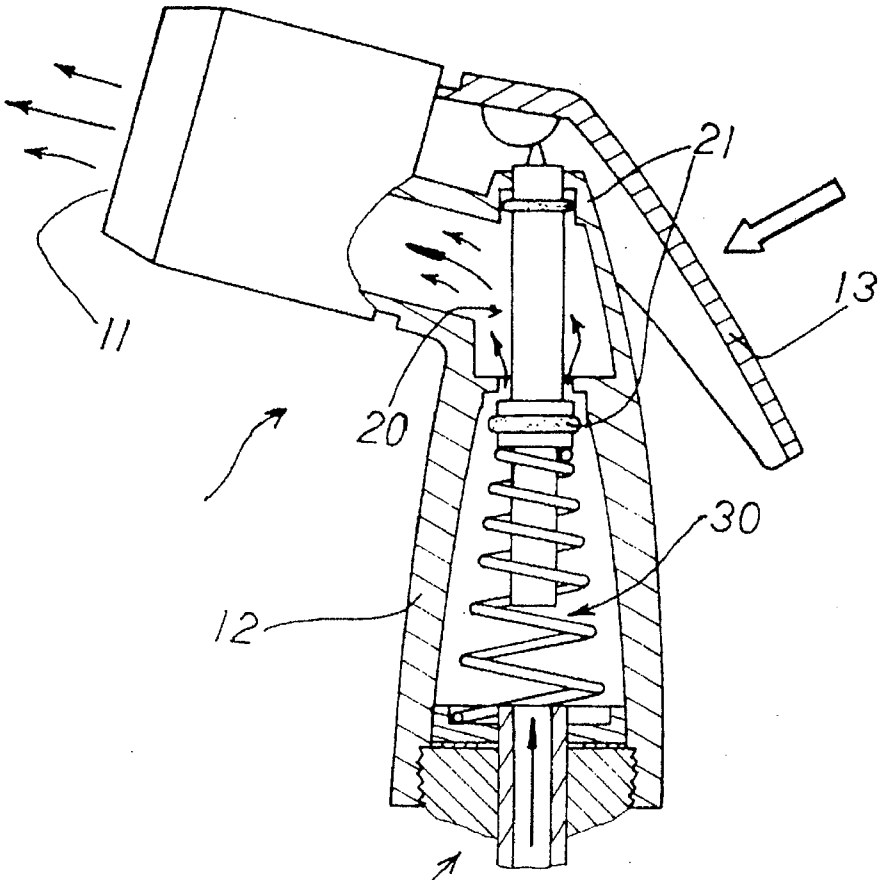
Figures 1, 2:
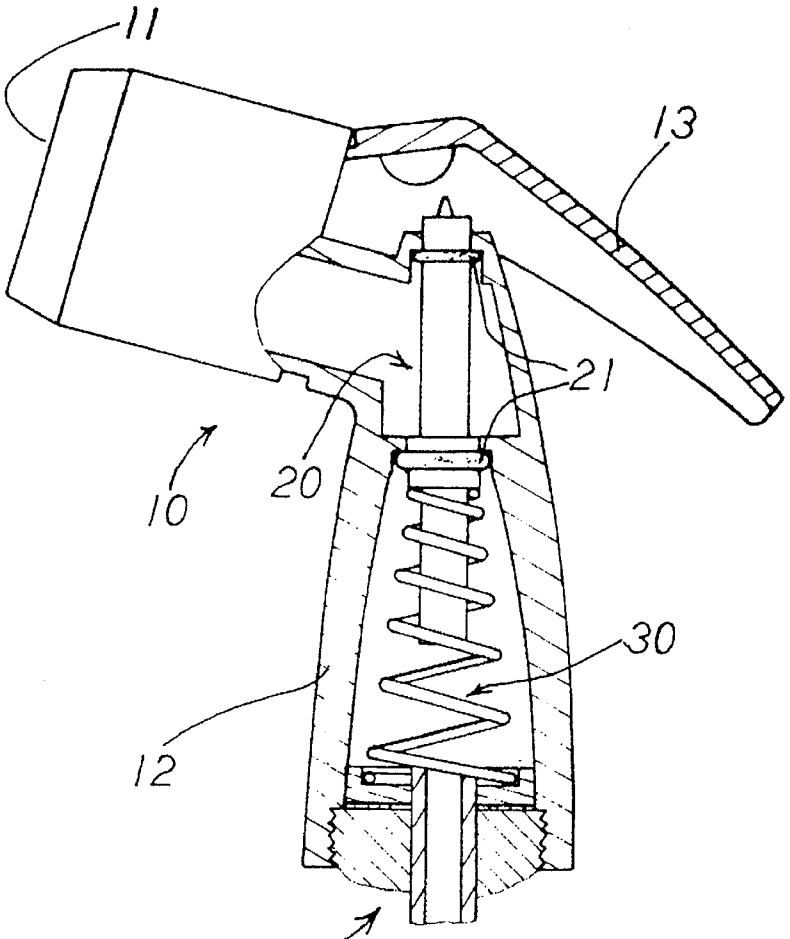
Figures 2, 4:
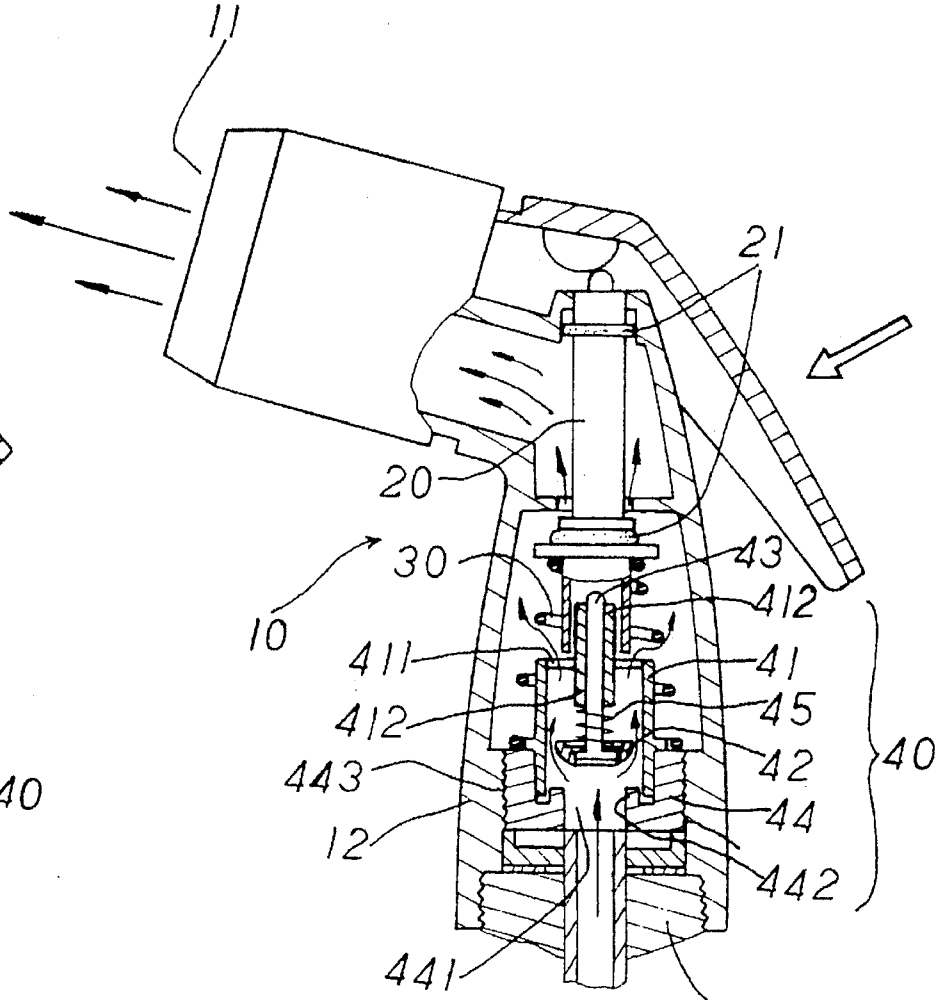
Figures 1, 4:
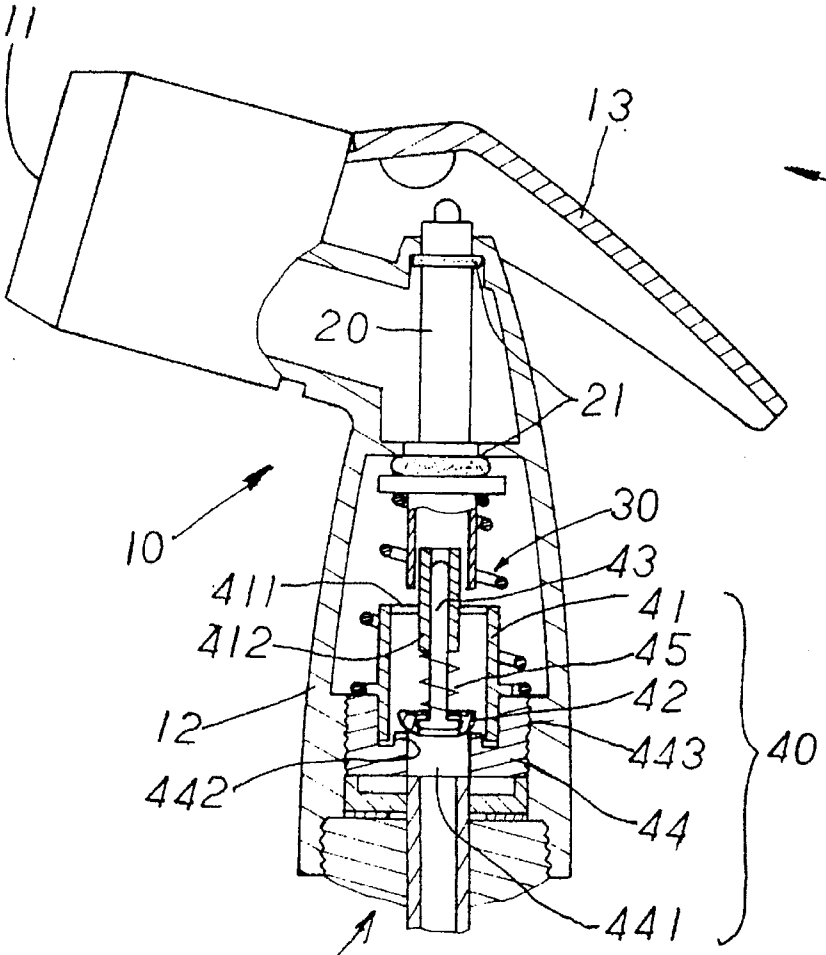

Referring to FIG. 4-2, when the water flows through the water hose 50 into the sprinkling head 10, the water first passed through the check assembly 40 to upward push the conic check pad 42. At this time, the spring 50 is compressed by the water pressure, permitting the water to enter the sprinkling head 10 to be sprinkled out from the sprinkling opening 11. After the water pressure disappears, the check pad 42 is pushed back to abut against the annular lip 442 of the water inlet 441 by the restoring force of the spring 50 as shown in FIG. 4-1. Therefore, in case an accident takes place and the sprinkling head is placed in a sink after washed, the dirty water is prevented from flowing back into the water hose 50.

The above embodiment is only an example of the present invention and the scope of the present invention should not be limited to the example. Any modification or variation derived from the example should fall within the scope of the present invention.

What is claimed is:

1. A check assembly of a sprinkling head for a kitchen cabinet, the sprinkling head being a hollow L-shaped tube member, having a sprinkling opening at a free end of a short pipe section of the sprinkling head, a controlling depression grip being connected to a bight section of the sprinkling head, a controlling valve stem being disposed in a long pipe section of the sprinkling head, an upper end of the valve stem protruding out of the bight section and two watertight washers being fitted around the valve stem, one of the watertight washers abutting against peripheral wall of a water outlet formed in the sprinkling head, a lower end of the valve stem being fitted with a conic spring and the check assembly and a free end of the long pipe section being connected with a water hose, whereby by means of depressing the depression grip, the controlling valve stem is lifted or lowered to control the sprinkling of the water flow from the sprinkling opening, said check assembly being characterized in that:

the check assembly includes a check valve seat, a plastic pin member fitted in the valve seat, a rubber-made soft conic check pad fitted around the pin member and a water inlet seat fitted with the valve seat, the check valve seat being a cylindrical body having a lower opening, a cross-like rib being formed on a top face of the valve seat and a hollow post extending downward and upward from a center of the cross-like rib, an annular flange being formed on outer wall of a middle section of the valve seat, one end of the pin member being disposed with a pin head and the other end thereof being a pin post, an upper face of the check pad being formed with a large sink and a lower face thereof being formed with a small sink, the two sinks being communicated by a central through hole, the pin post of the pin member being upward passed through the through hole to fit through a spring into the hollow post of the valve seat with the pin head engaged in the small sink of the check pad, the flange of the check valve seat being engaged with the water inlet seat and molten and sealed at an end of the water inlet seat by high frequency wave, an annular lip being formed in a water inlet of the water inlet seat, whereby the conic check pad is plugged into the water inlet and engaged with the annular lip, the water inlet seat having an outer thread section for engaging with inner thread of the long pipe section of the sprinkling head, the free end of the long pipe section being further engaged with the water hose; and when the depression grip is depressed and the water flows through the water hose into the sprinkling head, the water first passed through the check assembly to upward push the conic check pad and compress the spring, permitting the water to enter the sprinkling head to be sprinkled out from the sprinkling opening and after the water pressure disappears, the check pad is pushed back to abut against the annular lip of the water inlet by the restoring force of the spring so that in case an accident takes place with the sprinkling head placed in a sink after washed, the dirty water is prevented from flowing back into the water hose due to syphon effect.

* * * * *